United States Patent [19]

Tsuchiya et al.

[11] Patent Number: 4,985,330

[45] Date of Patent: Jan. 15, 1991

[54] PHOTOSENSITIVE MATERIAL FOR ELECTROPHOTOGRAPHY AND METHOD FOR MAKING SAME

[75] Inventors: Sohji Tsuchiya, Kanagawa; Mutsuaki Murakami, Machida; Susumu Yoshimura, Yokohama, all of Japan

[73] Assignee: Matsushita Electric Industrial Co., Ltd., Japan

[21] Appl. No.: 432,838

[22] Filed: Nov. 7, 1989

[30] Foreign Application Priority Data

Nov. 8, 1988 [JP] Japan ..... 63-281722
Nov. 8, 1988 [JP] Japan ..... 63-281721

[51] Int. Cl.[5] ..... G03G 5/06
[52] U.S. Cl. ..... 430/130; 427/74
[58] Field of Search ..... 430/127, 133, 134

[56] References Cited

FOREIGN PATENT DOCUMENTS 50-137738 11/1975 Japan .
61-149962 7/1986 Japan .
63-202753 8/1988 Japan .
1116553 5/1989 Japan .

*Primary Examiner*—David Welsh
*Attorney, Agent, or Firm*—Lowe, Price, LeBlanc, Becker & Shur

[57] ABSTRACT

A photosensitive material for electrophotography which comprises an electrically conductive support of a desired shape and an organic photoconductive layer formed on the substrate, is provided. The organic photoconductive layer is formed from a solution of an organic charge-generating compound, an organic charge transfer compound and an organic resin in an organic solvent after low temperature treatment thereof wherein the solution is cooled to a temperature sufficient not to cause the solutes to be precipitated or the solution to be coagulated for a time enough to allow interaction between the compounds and the resin binder and is returned to room temperature. This solution is applied to the support and dried to form a photoconductive layer on the support. The photoconductive layer may be of a single-layer structure or a double-layered structure wherein at least one sub-layer should be formed from a solution subjected to the low temperature treatment. A process for making the photosensitive material is also described.

7 Claims, No Drawings

PHOTOSENSITIVE MATERIAL FOR ELECTROPHOTOGRAPHY AND METHOD FOR MAKING SAME

BACKGROUND OF THE INVENTION

1. Field of the Invention

This invention relates to photosensitive materials for use in electrophotography wherein organic photoconductors are used for the formation of images for electrophotography and also to a method for making the photosensitive materials or mediums.

2. Description of the Prior Art

As a photoconductor used to constitute a photoconductive layer in photosensitive materials for use in electrophotography, there have been widely used inorganic materials or elements such as Se, CdS, amorphous silicon and the like. These photoconductors have, respectively, inherent drawbacks and are usually used in combination so as to make up the drawbacks of the respective photoconductors. However, existing photosensitive materials using inorganic photoconductors are not necessarily satisfactory in practical applications.

For instance, with Se, it is the usual practice to add Te or As in order to enlarge the range of spectral sensitivity with an attendant disadvantage that the light fatigue increases. Se, Te and As are all harmful to the human body. Although the Se photoconductor layer is usually applied in the amorphous state, this amorphous state will be lost at a temperature of about 65° C. or over by recrystallization, which leads to the deficiency that the dark resistance decreases.

When using CdS or ZnO, it is necessary to disperse it in appropriate resins, which presents problems with respect to the reproducibility of photoconductive characteristics and moistureproofness of the photoconductive layer. CdS is also harmful to the human body and ZnO has low photosensitivity.

While amorphous silicon has good photoconductive characteristics and durability, the manufacture process is complicated and thus, the amorphous silicon is expensive.

In place of these inorganic photoconductors, organic photoconductors which are often abbreviated to OPC have been recently studied and developed. Several organic photoconductors have now been in use. There is the recent trend toward the use of semiconductor laser devices as light sources. This promotes the developments of organic photoconductors which have sensitivity in a near infrared region. In general, organic photoconductor materials have not only the merit of ease in preparation, but also the advantages such as the capability of relatively easily varying a range of wavelength for photosensitivity by changing a molecular design with respect to the visible light sensitivity, good film-forming properties and lightweight properties.

The photosensitive materials for electrophotography using organic photoconductor materials are those of the builtup type which include a charge-generating layer (which may be hereinafter referred to simply as CGL) wherein carriers are generated by absorption of light, and a charge transfer layer (which may be hereinafter referred to simply as CTL) wherein the generated carriers are transferred. The respective photoconductive layers are formed by applying a charge-generating material and a charge transfer material, after mixing with binder resin, if necessary, onto a substrate such as a drum or a belt. It will be noted that in the photosensitive material of the builtup type, whether the CGL or CTL is formed as an upper layer depends on whether the charging is positive or negative.

Thus, the organic photoconductor material has the advantage that the photoconductive layer or layers can be formed by a simple coating process, but further improvements have been demanded with respect to the chemical stability or durability relative to environmental changes as well as sensitivity. More particularly, aside from the photosensitivity, the chemical stability against ozone or NO generated during the charging process, light fastness and wear resistance have to be further improved.

SUMMARY OF THE INVENTION

It is an object of the invention to provide a photosensitive material for use in electrophotography using organic photoconductors, which has high sensitivity and high stability and durability.

It is another object of the invention to provide a photosensitive material which may be either of a single-layer structure of a double-layer structure formed by applying at least a solution of photoconductor which has been subjected to low temperature treatment.

It is a further object of the invention to provide a photosensitive material for electrophotography which comprises a cured resin as a resin binder whereby the stability and durability can be further improved.

Since it is generally accepted that the stability and durability of organic photoconductors chiefly depend on the characteristics of charge-generating compounds and/or charge transfer compounds, the relationship between these compounds and the resin binder has rarely been discussed up to now. With respect to the solution used to form a photoconductive layer on a support, only solubilities of photoconductive components and resin binders are studied but little investigation has been made on the interaction between the molecules of solvent and solute components and also on the relation between the characteristics of the final photoconductor material and the type of solvent.

We made studies on photoconductor materials from an angle different from known ones. More particularly, studies have been made on the intermolecular action of individual components in the solution used to form a charge-generating or charge transfer layer. As a result, it has been found that an increasing interaction of the respective components of the solution is important. Moreover, binder resins useful for stabilizing the photoconductive layer or layers have been developed.

Broadly, the photosensitive material according to the invention comprises an electrically conductive support of a desired shape and an organic photoconductive layer formed on the substrate. The organic photoconductive layer is formed by a process which comprises the steps of: subjecting a solution of an organic charge-generating compound, an organic charge transfer compound and an organic resin in an organic solvent to low temperature treatment wherein the solution is cooled to a temperature sufficient not to cause the solutes to be precipitated or the solution to be coagulated for a time enough to allow the interaction between the compounds and the resin binder and is returned to room temperature; applying the thus treated solution onto the substrate; and drying the applied solution to form a photoconductive layer on the support. The charge-generating compound and the charge transfer compound may be separately dissolved in the organic solvent wherein at least one of the solutions should contain a resin binder. In this case, the at least one solution should be cooled, returned to room temperature and applied as described above while the other solution may be applied without the cooling.

Preferably, all the compounds, resin binder and organic solvent should have a ring structure in the respective molecules. More preferably, the ring structure is an aromatic ring. The low temperature treatment should be carried out at temperatures which do not allow the solute component or components to be precipitated or do not permit the solution to be entirely coagulated.

In a preferred embodiment, the binder used in the photoconductive layer or layers should be a curable resin which is finally cured in the layer or layers. If the photoconductive layer is of the double or multi-layered structure, at least one layer should contain the cured resin.

The present invention also provides a method for making a photosensitive material which comprises providing a solution of an organic charge-generating compound and/or an organic charge transfer compound, and a resin binder in an organic solvent, the organic charge-generating compound and/or organic charge transfer compound, resin binder and organic solvent having, respectively, a ring structure in the molecule, cooling the solution from normal temperatures to a temperature at which the solute component or components are not allowed to precipitate or the solution is not allowed to coagulate, returning the thus cooled solution gradually to normal temperatures, and applying the returned solution to a conductive support.

DETAILED DESCRIPTION AND EMBODIMENTS OF THE INVENTION

The photoconductive material according to the invention comprises an electrically conductive support and a photoconductive layer which may have either a single-layer structure or a multi-layer structure. The material for the conductive support is not critical and is properly selected depending on the use of final photoconductive material. Preferable examples of such a support include metal plates such as Al, and deposited films of metals, such as Al, formed on the surface of various materials such as glass, paper, plastics and the like. The support may take any desired form such as a sheet, a belt, a drum or the like.

The photoconductive layer is formed on the conductive support and may have a single-layer structure or a multi-layer structure. The thickness of the photoconductive layer is not critical and is generally in the range of from 0.1 to 30 micrometers.

With the photoconductive material having the multi-layer or double-layer structure, a charge-generating layer containing a charge-generating compound and a charge transfer layer containing a charge transfer compound are formed on the substrate. For the formation of the charge-generating layer and the charge transfer layer, two solutions, respectively, containing a charge-generating compound and a charge transfer compound are prepared. At least one of the solutions should be subjected to low temperature treatment and is formed as an upper layer. It will be noted that the order of formation of the two layers in the double-layer structure depends on the manner of charging and is not thus critical.

The charge-generating compounds useful in the present invention may be any known compounds and are organic dyes and pigments including, for example, perylene compounds, phthalocyanine compounds, thiapyrilium compounds, anthanthrone compounds, azulenium compounds, aquarylium compounds, tris-azo compounds, and bis-azo compounds. These compounds may be used singly or in combination. Preferably, those compounds which exhibit sensitivity to light having a long wavelength are used and include tris-azo compounds and phthalocyanine compounds. More preferably, phthalocyanine compounds are used. Specific examples of the phthalocyanine compounds include phthalocyanine and complexes of phthalocyanine such as Cu phthalocyanine, Ti—O phthalocyanine, Pb phthalocyanine, Ag—Cl phthalocyanine, Mg phthalocyanine, In—Cl phthalocyanine and mixtures thereof.

The charge transfer compound may also be any known compounds including, for example, hydrazone compounds, pyrazoline compounds, triarylmethane compounds, oxazole compounds, polarylaklanes and the like. Examples of the hydrazone compound include p-diethylaminobenzaldehyde-N,N-diphenylhydrazone, p-diethylaminobenzaldehyde-N,N-α-naphthyl-N-phenylhydrazone, 1,2,3-trimethylindolemin-ω-aldehyde-N,N-diphenylhydrazone, p-diethylbenzaldehyde-2-methylbenzthiazolin-2-hydrazone and the like. Examples of the pyrazoline compound include 1-phenyl-3-(p-diethylaminostyryl)-5-(p-diethylaminophenyl)-pyrazoline, 1-[xylyl(2)]-3-(p-diethylaminostyryl)-5-(p-diethylaminophenyl)pyrazoline, 1-[5-methoxypyridyl(20]-3-(p-diethylaminostyryl)-5-(p-diethylaminophenyl)-pyrazoline, 1-[pyridyl(3)]-3-(p-diethylaminostyryl)-5-(p-diethylaminophenyl)pyrazoline, 1-[pyridyl(2)]-3-(α-methyl-p-diethylaminostyryl)-6-(p-diethylaminophenyl)pyrazoline, 1-phenyl-3-(α-benzyl-p-diethylaminostyryl)-5-(p-diethylaminophenyl)pyrazoline and the like. Examples of triarylmethane compound include bis(4-diethylamino-2-methylphenyl)-phenylmethane. Examples of oxazole compound include 2-(p-diethylaminostyryl)6-diethylaminobenzoxazole, 2-(p-diethylaminophenyl)-4-(p-dimethylaminophenyl)-5-(2-chlorophenyl)oxazole and the like. Examples of the polyarylalkane include 1,2-bis(N,N-diethylamino-2-methylphenyl)heptane, 1,1,2,2-tetrakis(4-N,N-dimethylamino-2-methylphenyl)ethane and the like. Aside from the above-indicated compounds, pyrene compounds, arylamine compounds and the like may also be used. These compounds may be used singly or in combination. Of these, the hydrazone compounds are preferred.

For the formation of the double-layer structure, the charge-generating compound and the charge transfer compound are, respectively, dissolved in an organic solvent along with a resin binder, if necessary, thereby providing two solutions. As will be described hereinafter, at least one solution is subjected to low temperature treatment. It will be noted here that when the other solution is not subjected to low temperature treatment, this solution may not contain any binder therein but contains only a charge-generating compound or a charge transfer compound dissolved in solvent.

The resin binder used for this purpose should be an insulating resin and should have good solubility in the organic solvent used. In general, polyvinylbutyral, polyesters, polycarbonates, acrylic resins and mixtures thereof are used.

The organic solvent may be any compound capable of dissolving the charge-generating compound, charge transfer compound and resin binder.

Preferably, the charge-generating compound, charge transfer compound, resin binder and organic solvent are used and should, respectively, have a ring structure, such as an aromatic ring, an alicyclic ring or a heterocyclic ring, at any position in the molecule. More preferably, these compounds, resin binder and organic solvent should, respectively, have an aromatic ring. In this connection, the charge-generating and transfer compounds indicated before have, respectively, a ring structure.

Preferred resin binders are those indicated before which are substituted with a ring structure at any position in the main chain, side chain or terminal end thereof. Typical examples of this type resin includes polyethylene terephthalate, polystyrene, polycarbonates and the like.

Preferred examples of the organic solvent include aromatic compounds such as benzene, toluene, xylene and the like, heterocyclic compounds such as tetrahydrofuran, dioxane, pyridine, γ-butyrolactone and the like.

For the preparation of the respective solutions, the charge-generating and transfer compounds are each dissolved at a concentration of from 3 to 30 wt %, and the organic binder resin in dissolved at a concentration of from 3 to 50 wt %. The ratio by weight of the compound and the resin is generally in the range of from 1:10 to 1:1.

Where the photosensitive material of the single-layer type is made, a solution of a mixture of the charge-generating compound and charge transfer compound indicated before is prepared instead of the two solutions for the multi-layered structure.

The thus prepared solution or at least one solution for the multi-layered structure is subjected to low temperature treatment prior to its application. It is assumed that, by the treatment, the respective components in the solution are intermolecularly associated with one another, e.g. if these components have, respectively, an aromatic ring, these rings are interacted to form a kind of association. Once associated, this condition has been found to be maintained after returning the temperature of the solution to room temperature. Since the associated state in the solution is kept, the solution becomes high in viscosity. In the layer formed from the solution, the charge-generating and/or transfer compound and the resin binder are intermolecularly combined strongly, resulting in improved sensitivity and stability along with a uniform layer structure.

The low temperature treatment of the solution is effect in such a way that the solution is cooled down to a temperature at which the solute component or components are not allowed to be precipitated or the solution is not allowed to be coagulated as a whole. The thus cooled solution is kept for a time sufficient to permit the association between the component or components and the resin binder. Thereafter, the cooled solution is returned to room temperature gradually. The cooling temperature and cooling rate differ depending on the type of solution.

For instance, tetrahydrofuran has a coagulation point of −108.5° C. This compound has great capability of dissolving a binder resin, for example, polyethylene terephthalate, and charge-generating compounds and charge transfer compounds, so that even when the solution in tetrahydrofuran is allowed to stand at a low temperature of −30° to −40° C., its uniformity can be maintained. The solution can be cooled at a high rate, for example, by placing it directly in a vessel kept at approximately −30° C.

With γ-butyrolactone having a coagulation point of −43.5° C., when a binder resin such as an acrylic resin, charge-generating compounds and charge transfer compounds are dissolved or dispersed in the lactone and subjected to low temperature treatment wherein the solution is placed directly in a vessel maintained at about −30° C., phase separation will take place. However, when the solution is gradually cooled at a rate, for example, of −2° C./minute, the phase separation will not occur. The phase separation is more likely to occur when the concentration of binder resin is higher, under which the cooling rate should be slower.

When toluene having a coagulation point of −95° C. is used as the solvent, it is preferred to use a resin having a benzene ring as a binder resin and phthalocyanine compound or hydrazone compound having a benzene ring as a charge-generating compound or a charge transfer compound. After dissolution or dispersion of the resin and these compounds in toluene, the solution is subjected to low temperature treatment. When the solution is quickly cooled down, for example, to −20° C., the hydrazone or phthalocyanine compound is flocculated. However, when the solution is gradually cooled at a rate of not higher than −3° C./minute, such a phase separation does not occur. After keeping at −20° C. for 3 hours or over, the solution is returned to normal temperatures. At this stage, the solution has a viscosity higher than that prior to the low temperature treatment, demonstrating that the interaction or association between the binder resin and the phthalocyanine or hydrazone compound through the molecules of the solvent takes place.

As will be apparent from the above, the temperature to which the solution is cooled should preferably be not higher than 0° C., more preferably in the range of from −15° C. to −40° C., which may depend on the types of solvent, resin and charge-generating and/or transfer compound. The retaining time should preferably be at least 0.5 hours in order to ensure the interaction.

Preferably, the solution should be slowly returned to normal temperatures so that the state or structure formed in the solution at low temperature is unlikely to be broken. Usually, the temperature of the solution is raised at a rate of from 1° to 10° C./minute.

The low temperature treatment where the solution is cooled to a temperature, retained at this temperature, and returned to normal temperature may be repeated several times in order to accomplish an increasing degree of the interaction between the resin binder and the charge-generating and/or transfer compound. Once again, with the photosensitive material of the multi-layered type, it is sufficient to subject at least one of the solutions of charge-generating and charge transfer compounds to the low temperature treatment.

The thus treated solution is applied onto an electrically conductive support by any known technique including, for example, dipping, spraying, spin coating and the like. When the multi-layered structure is used, a solution for the upper layer should be subjected to low temperature treatment. Subsequently, the applied layer is dried after which another solution is further applied if the multi-layered structure is formed.

The total thickness of the photoconductive layer is not critical and is generally in the range of from 0.5 to 30 micrometers.

In order to further improve the sensitivity and the stability and durability of the photosensitive material according to the invention, the resin binder comprises a curable resin and is cured in a final photoconductive layer. The curable resins usable for this purpose are those which are curable by application of energy rays such as UV rays, electron rays and X-rays or by application of heat. As a matter of course, various additives such as polymerization initiators may be added to the resin binder. In addition, vinyl monomers may be used in combination of the curable resin binder. Examples of the curable resin include polymethyacrylic resins having an epoxy group and/or a vinyl group at side chains or having a chalcone structure, polymethacrylic resins having a vinyl group at the main chain, cyclized rubber, silicone resins, copolymers of the monomers used for the resins indicated above, and mixtures thereof. Moreover, those resins which have a quaternary carbon atom having the high possibility of undergoing crosslinking reaction by application of high energy beams such as electron beams, X-rays and the like. Examples of such resins include, aside from polymethacrylic resins and silicone resins indicated above, poly-α-methylstyrene, and polymethyacrylic resins, silicone resins and poly-α-methylstyrene both having a halogen atom, and mixtures thereof.

These curable resins may be used in combination with the insulating thermoplastic resins defined in the foregoing embodiment such as, for example, polyvinylbutyral, polyesters, polycarbonates, acrylic resins and the like. In this case, the insulating resin is preferably used in an amount of not larger than 90 wt % of the total of the insulating resin and a curable resin used.

The solution containing the curable resin along with a charge-generating compound and/or a charge transfer compound is subjected to low temperature treatment in the same manner as in the first embodiment and applied onto a conductive support. After completion of the application, the applied layer is irradiated with energy beams or applied with heat to cure the resin. For the formation of a multi-layered structure wherein a curable resin is used for both solutions of a charge-generating compound and a charge transfer compound, one solution is first applied and dried and then the other solution is applied on the dried layer, after which both layers are cured simultaneously. Alternatively, the first layer may be initially cured, after which the other solution is applied and cured. With the multi-layered structure, at least one layer should be made of a cured resin layer containing layer either a charge-generating compound or a charge transfer compound. If only one layer is necessary for curing, two layers may be successively formed, after which the layer required to cure can be cured.

The photosensitive material according to the invention may be applied to various fields including duplicators, printers, facsimiles and other printing systems. If necessary, the photosensitive material of the invention may further include a surface protective layer made of an insulating resin and formed on the top of the photoconductive layer structure. Alternatively, a Se layer may be formed between the photoconductive layer or layers and the conductive support.

The present invention is more particularly described by way of examples.

EXAMPLE 1

X-type phthalocyanine (Fastogen Blue 8120B, available from Dianippon Inks Co., Ltd.) was provided as charge-generating compound, a hydrazone compound (CTC-236, available from Anan Perfume Inc. Co., Ltd.) was provided as a charge transfer compound, and a polyester resin (Vylon 200, available from Toyobo Ltd.) was provided as a binder. The X-type phthalocyanine was dispersed and dissolved in dioxane at a concentration of 5 wt % and the resultant solution was applied onto an Al substrate by a spinner to form a charge-generating layer. Thereafter, a tetrahydrofuran solution containing 10 wt % of the hydrazone compound and 10 wt % of the polyester was prepared. This solution was cooled from room temperature to −20° C. at a cooling rate of −2° C./minute and retained at the temperature for 1 hour. Subsequently, the solution was gradually returned to room temperature at a rate of 5° C./minute. This low temperature treatment was repeated three times in total, after which the solution of the charge transfer compound was applied by dipping on the charge-generating layer in a thickness of approximately 20 micrometers, thereby forming a charge transfer layer.

COMPARATIVE EXAMPLE

The general procedure of Example 1 was repeated except that the solution containing the charge transfer compound was not subjected to the low temperature treatment, thereby forming a photosensitive material for electrophotography of the builtup type.

The photosensitive materials obtained in the example and comparative example were each statically corona charged at −5 kV by the use of an electrostatic duplicating paper test device (EPA-8100, available from Kawaguchi Electric Co., Ltd.) and kept for 3 seconds in the dark. Thereafter, it was exposed to light at an illuminance of five luxes to determine charge characteristics.

The charge characteristics were a surface potential (Vo), a potential (Vi) after attenuation in the dark for three seconds, and an exposure ($E\frac{1}{2}$) necessary for attenuating the potential, Vi, to half. These characteristics were measured at the initial stage and after the measurement was repeated 5000 times. Moreover, the respective materials were subjected to an abrasion test wherein their surface was rubbed with a gauze to determine the number of rubbing times before the defects on the surface were visually observed.

The results are shown in Table 1 below.

TABLE 1

| | | Example | Comparison |
|---|---|---|---|
| Vo (volts) | initial value | −580 | −700 |
| | after 5000 repetitions | −570 | −680 |
| Vi (volts) | initial value | −500 | −620 |
| | after 5000 repetitions | −490 | −600 |
| $E\frac{1}{2}$ (lux · second) | initial value | 1.8 | 2.5 |
| | after 5000 repetitions | 1.8 | 2.8 |
| Abrasion Resistance rubbing times before visual observation of defects | | 25000 | 18000 |

As will be apparent from the above table, the photosensitive material of the example is better in all the sensitivity, stability and durability than that of the comparative example.

EXAMPLE 2

A perylene compound was provided as the charge-generating compound, a hydrazone compound as used in Example 1 was also provided as the charge transfer compound, and polyvinylbutyral was provided as a binder for the charge transfer layer. The general procedure of Example 1 was repeated except that the hydrazone compound was dissolved in cyclohexanone along with polyvinylbutyral and the resultant solution was cooled down to −15° C. at a cooling rate of −1° C./minute and allowed to stand at −15° C. over day and night, followed by returning to normal temperatures at a rate of 5° to 10° C./minute, thereby obtaining a photosensitive material. This material was subjected to measurement of characteristic properties in the same manner as in Example 1. The results were similar to those of Example 1.

EXAMPLE 3

X-type phthalocyanine (Fastogen Blue 8120B, available from Dianippon Inks Co., Ltd.) was provided as a charge-generating compound, a hydrazone compound (CTC-236, available from Anan Perfume Ind. Co., Ltd.) was provided as a charge transfer compound, and a photocurable polymethacrylic resin having epoxy and vinyl groups at side chains (FVR, available from Fuji Medical Co., Ltd.) was provided as a binder. The X-type phthalocyanine was dispersed and dissolved in dioxane at a concentration of 5 wt % and the resultant solution was applied onto an Al substrate in a thickness of about 0.5 micrometers by a spinner to form a charge-generating layer. A cyclohexanone or tetrahydrofuran solution of 5 wt % of the hydrazone compound and 5 wt % of the binder was prepared, followed by cooling from room temperature to −20° C. at a cooling rate of −1° C./minute and keeping for 3 hours. Thereafter, the solution was gradually returned to room temperature at a rate of 10° C./minute. This low temperature treatment was repeated three times in total. The resultant solution was applied by dipping on the charge-generating layer in a thickness of 15 micrometers and irradiated with a UV ray from a mercury lamp to cure the FVR resin to obtain a photosensitive material of the builtup type.

EXAMPLE 4

A curable polymethyacrylic resin (FDER, available from Fuji Medical Co., Ltd.) having a chalcone structure at side chains was used. This resin was curable by application of UV rays or by application of heat at 150° C. or over. The phthalocyanine used in Example 3 was dispersed and dissolved in a toluene solution of the polymethacrylic resin and subjected to low temperature treatment wherein it was cooled down to −15° C. at a rate of −2° C./minute and allowed to stand over day and night at −15° C. Thereafter, the solution was returned to normal temperatures at a rate of 5° C. to 10° C./minute and applied onto an Al support, followed by thermal treatment at 150° C. for 1 hour to cure. Subsequently, a charge transfer layer was formed on the cured layer in the same manner as the charge-generating layer but using a hydrazone compound as used in Example 3, thereby obtaining a photosensitive material.

The photosensitive materials obtained in Examples 3 and 4 were tested in the same manner as in the foregoing examples. The results are shown in Table 2below.

TABLE 2

| | | Example 3 | Example 4 |
|---|---|---|---|
| Vo (volts) | initial value | −370 | −550 |
| | after 5000 repetitions | −420 | −570 |
| Vi (volts) | initial value | −305 | −510 |
| | after 5000 repetitions | −335 | −520 |
| $E_{\frac{1}{2}}$ (lux · second) | initial value | 1.4 | 1.2 |
| | after 5000 repetitions | 1.0 | 0.7 |
| Abrasion Resistance rubbing times before visual observation of defects | | 41000 | 65000 |

As will be apparent from the comparison between the above results and the results of Table 1, the photosensitive materials using the cured resins are improved in the chemical stability and durability than the photosensitive material using the thermoplastic insulating resin used in Example 1.

What is claimed is:

1. A process for forming a photosensitive material for electrophotography which comprises:

preparing a solution of a charge-generating compound and/or a charge transfer compound and a resin binder in an organic solvent wherein the charge-generating compound and/or charge transfer compound, the resin binder and the organic solvent have, respectively, a ring structure in the molecule;

subjecting the solution to low temperature treatment wherein said solution is cooled from normal temperatures to a temperature which does not cause the solutes to be precipitated or the solution to be coagulated, for a time enough to allow interaction between the compound or compounds and the binder and is gradually returned to normal temperatures;

applying the thus treated solution onto an electrically conductive support; and drying the applied solution to form a photoconductive layer on the support.

2. The process according to claim 1, wherein said solution contains both charge-generating compound and charge transfer compound.

3. The process according to claim 1, wherein said solution contains either the charge-generating compound or charge transfer compound, and the compound which is not contained in the solution is dissolved in an organic solvent and is applied without undergoing the low temperature treatment.

4. The process according to claim 1, wherein the temperature is in the range of from −15° C. to −40° C.

5. The process according to claim 1, wherein the cooled solution is returned to normal temperatures at a rate of from 1° to 10° C./minute.

6. The process according to claim 1, wherein the low temperature treatment procedure is repeated several times.

7. The process according to claim 1, wherein said binder consists essentially of a curable resin and, after the application, the curable resin is cured.

* * * * *